US005205926A

United States Patent [19]

Lawrence

[11] Patent Number: 5,205,926

[45] Date of Patent: Apr. 27, 1993

[54] FROTH FLOTATION MACHINE

[75] Inventor: George A. Lawrence, Weston, Conn.

[73] Assignee: Dorr-Oliver Incorporated, Milford, Conn.

[21] Appl. No.: 849,114

[22] Filed: Mar. 9, 1992

[51] Int. Cl.[5] ..... B03D 1/14; B03D 1/16

[52] U.S. Cl. ..... 209/168; 209/169; 210/221.1; 210/201

[58] Field of Search ..... 209/169, 168, 170; 210/221.1, 221.2, 200, 201, 202, 322

[56] References Cited

U.S. PATENT DOCUMENTS

| | | | |
|---|---|---|---|
| 1,294,531 | 2/1919 | Pennington | 209/169 |
| 1,457,077 | 5/1923 | Janney | 209/169 |
| 2,612,358 | 9/1952 | Daman | 209/169 |
| 2,765,078 | 10/1956 | Kelsey | 209/169 |
| 3,037,626 | 6/1962 | Takahashi | 209/169 |
| 3,342,331 | 9/1967 | Maxwell | 209/169 |
| 3,409,130 | 11/1968 | Nakamura | 209/169 |
| 3,437,203 | 4/1969 | Nakamura | 209/169 |
| 4,566,968 | 1/1986 | Kivisto | 209/169 |

FOREIGN PATENT DOCUMENTS

| | | | |
|---|---|---|---|
| 1023881 | 1/1978 | Canada | 210/221.1 |
| 807262 | 6/1951 | Fed. Rep. of Germany | 209/169 |
| 1234633 | 2/1967 | Fed. Rep. of Germany | 209/169 |
| 1387502 | 2/1964 | France | 209/169 |

*Primary Examiner*—Stanley S. Silverman
*Assistant Examiner*—Thomas M. Lithgow
*Attorney, Agent, or Firm*—Harold M. Snyder

[57] ABSTRACT

The invention relates to an improved flotation cell design for the mining industry. The flotation cell includes a cylindrical froth flotation unit and a unique hexagonal overflow froth launder. The unique design optimizes the froth flotation process and allows for the economical utilization of a honeycomb nesting arrangement.

8 Claims, 2 Drawing Sheets

FROTH FLOTATION MACHINE

BACKGROUND OF THE INVENTION

This invention relates to an improved flotation machine and cell design for the mining industry and, in particular for the process of separating minerals from ore through flotation of the mineral and removal from the ore.

In the mining industry, flotation is the primary method for concentrating and recovering minerals utilizing copper flotation, fine coal flotation, iron ore flotation, phosphate rock and potash flotation, base metal sulfide flotation and precious metal sulfide flotation.

Flotation is essentially a three phase unit process involving the intimate mixing of finely ground solids, liquids, and air to concentrate desired minerals from gangue by floating one away from the other. In carrying out the flotation process, the ore is crushed into finely ground solids and mixed with liquids to form a slurry or pulp. The slurry is then aerated using a flotation machine to achieve solid/liquid mixing and air dispersion through an internal air source or by a self-aspirating flotation machine. U.S. Pat. Nos. 4,425,232 and 4,800,017 describe a flotation separation apparatus and method comprising a flotation machine provided with a rotor-stator pump assembly submerged in a slurry and in which rotor blades agitate the slurry thoroughly mixing the solids and liquid and introducing air to the mixture for aeration and generation of froth or foam on the surface of the flotation cell. Particles of minerals attach to carrier air bubbles which are naturally buoyant and form the froth, this being the effective mechanism for mineral recovery. The froth is removed hydrodynamically from the top of the slurry mass together with the entrapped mineral particles which are recovered as froth is accumulated and dewatered.

Conventional cell tank designs as depicted in FIG. 1, labelled prior art, are rectangular or U-shaped and use a long froth overflow launder and partition plates. The froth overflow launder is generally longitudinally placed along side the tank, though some designs make use of a cross launder along the partition plate. Froth containing the desired minerals, which has risen with the air bubbles created by the rotor or mixer, overflows onto the launder and runs into a discharge pipe for collection.

Prior tank and overflow launder designs have proved inefficient and costly. The reinforced rectangular tank design contains corners and flat sides which must be heavily reinforced against bulging forces. Further, corners which exist in the rectangular design promote waste due to eddy currents and/or stagnant pockets. Launders are built independent from the flotation tanks and are often self-supporting.

It is an object of this invention to produce an economical cell and froth overflow launder design which provides a high ratio of froth overflow lip length to cell tank volume, with less troublesome cross launders. Cross launders provided in the prior art interfere with flow patterns and encroach on useful flotation volume.

It is a further object of this invention to produce a flotation cell and froth overflow launder design wherein the flotation tank volume is fully utilized due to the elimination of all corners.

Further, it is an object of this invention to produce a flotation cell and overflow froth launder design that can be arranged to maximize building floor space and thereby minimize costs.

This invention is directed to these objectives and others with specific reference to flotation equipment.

SUMMARY OF THE INVENTION

The improved flotation machine, cell and overflow froth launder design according to the invention includes a cylindrical tank and a unique hexagonal overflow launder configuration. The unique hexagonal overflow froth launder allows for a unique nesting of adjacent rows of cells into a beehive arrangement. Each of the cylindrical tanks contain a rotating mechanism which operates to create the bubbles to which desired minerals adhere for froth production. The hexagonal overflow froth launders contain a plurality of bottom discharge outlets for collection of the froth. The hexagonal launders are integral with the cylindrical tanks, with the tank wall forming one side of the launder.

The unique cylindrical cell design and hexagonal peripheral overflow froth launder provides a high ratio of froth overflow lip length to cell tank volume often eliminating the need for troublesome cross launders.

The cylindrical shape and circular cross-section of the cell eliminates troublesome corners which produce waste due to areas of stagnation or eddy current formation.

The cylindrical shape is self-reinforcing and avoids flat sides that would require heavy reinforcing to protect against bulging.

Further, the unique hexagonal overflow launder design facilitates a beehive or honeycomb nesting arrangement of the flotation tanks thereby effectively utilizing building space and minimizing building expenses.

The above and other objects, as well as the advantageous features of the invention will become more clear from the following description taken in conjunction with the accompanying drawings.

DETAILED DESCRIPTION OF THE INVENTION

Figure 1:
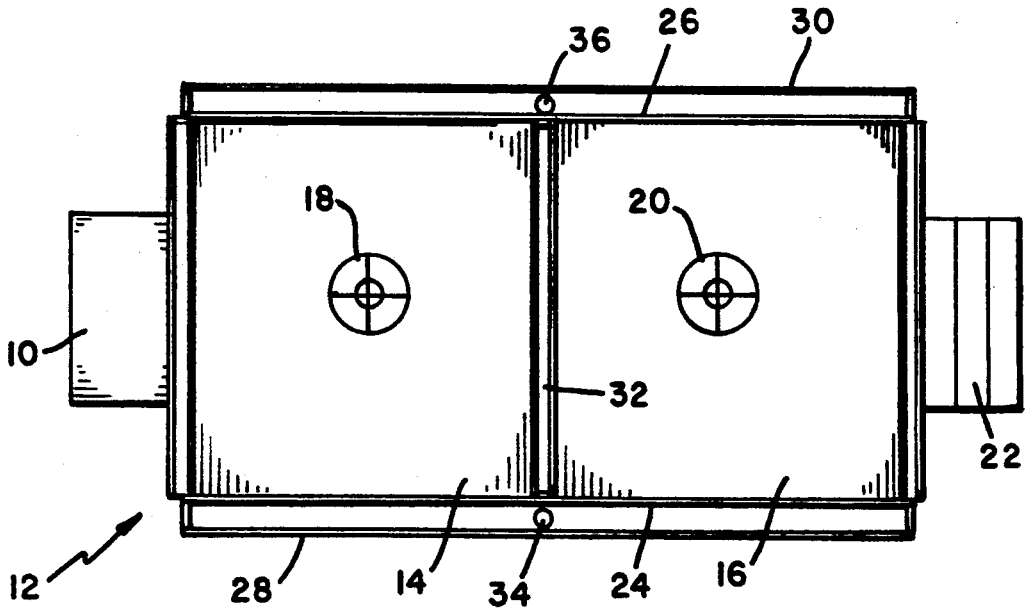
FIG. 1 (Prior Art)
FIG. 1 is a top plan view of a prior art configuration.

Referring to the drawings, particularly to FIG. 1, the prior art flotation cell and overflow froth launder design includes a feed box 10 wherein finely ground ore is mixed with a liquid and fed into the flotation apparatus 12. The apparatus 12 contains two compartments or cells 14 and 16, respectively. In each of the cells there is provided a rotation device or mechanism, 18 and 20, respectively, which produces air bubbles for froth flotation. Further, there is provided a discharge box 22 for removal of unseparated solid and liquid. Provided along the longitudinal edges, 24 and 26, of the cells are conventional froth overflow launders, 28 and 30, respectively.

Lastly, the conventional flotation apparatus 12 contains a partition plate and a cross froth launder 32 thereon, which divides the apparatus into two cells.

Contained in the bottom of the froth overflow launders, 28 and 30, are froth discharge outlets 34 and 36.

The prior art structure, as depicted in FIG. I, is lacking in its inefficient shape and launder arrangement.

Figure 2:
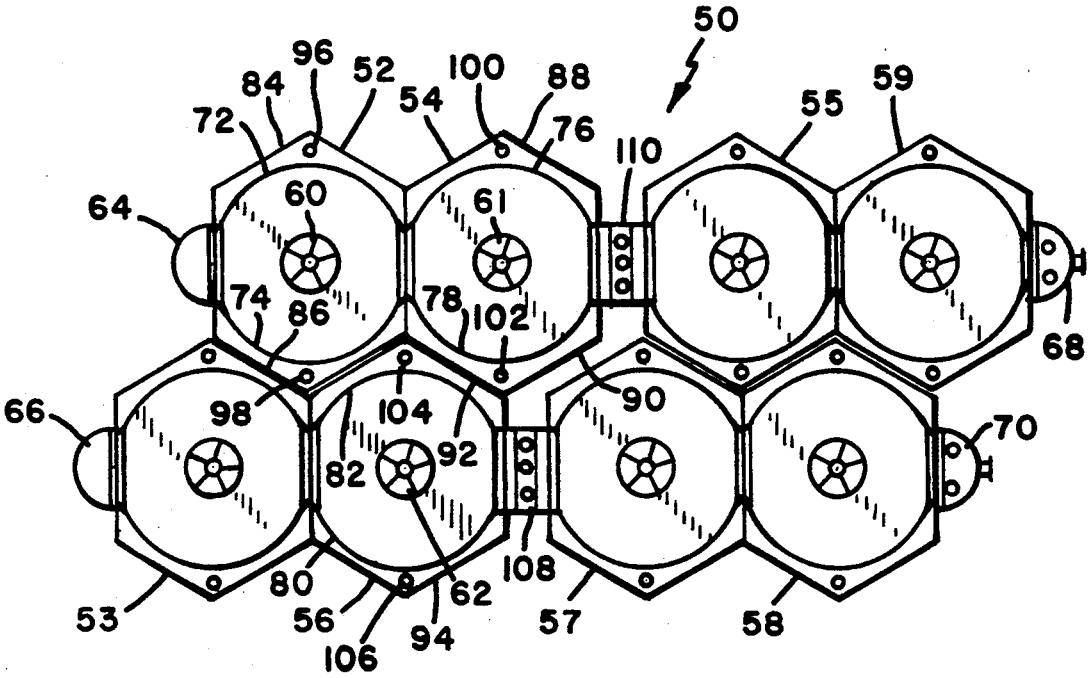
FIG. 2 is a top plan view of a plurality of tanks nested in beehive arrangement in accordance with the invention.
Figure 3:
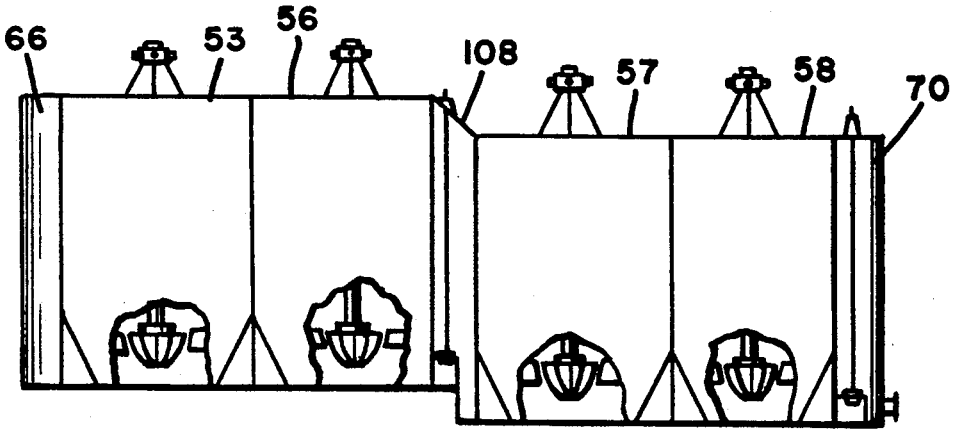
FIG. 3 is an elevational view of the beehive arrangement of FIG. 2.

Referring to FIGS. 2 and 3, the improved flotation machine and overflow froth launder arrangement is depicted. The flotation machine 50 includes a plurality of cylindrical flotation cells 52, 53, 54, 55, 56, 57, 58 and 59. Focusing on three of the cells for analysis, they each contain a rotation mechanism, 60, 61 and 62 for production of bubbles to be utilized in mineral separation. Feed boxes 64 and 66 are provided as inlet ports for feeding liquid and finely ground ore into the machine. Discharge boxes 68 and 70 are provided for the removal of unseparated solids and liquids.

Cell tank edges 72, 74, 76, 78, 80 and 82 are bordered by hexagonal overflow froth launders having sides 84, 86, 88, 90, 92 and 94, which contain froth discharge outlets 96, 98, 100, 102, 104 and 106, respectively. Mineral rich froth overflows from cells 52, 54 and 56 into the bordering hexagonal overflow froth launders in an efficient and optimized fashion. Due to the hexagonal configuration of the cells and their launders, the flotation devices nest together in a unique and efficient beehive or honeycomb fashion. Shallow, cross launders are employed to enhance the arrangement.

Further, there is provided, if desired junction boxes 108 and 110 to accommodate descending levels of an installation. Such an installation will compensate for loss of head as the slurry passes through the cell array. FIG. 3 illustrates the utilization of the junction box 108 to connect descending groupings of cells 56 and 57.

Figure 4:
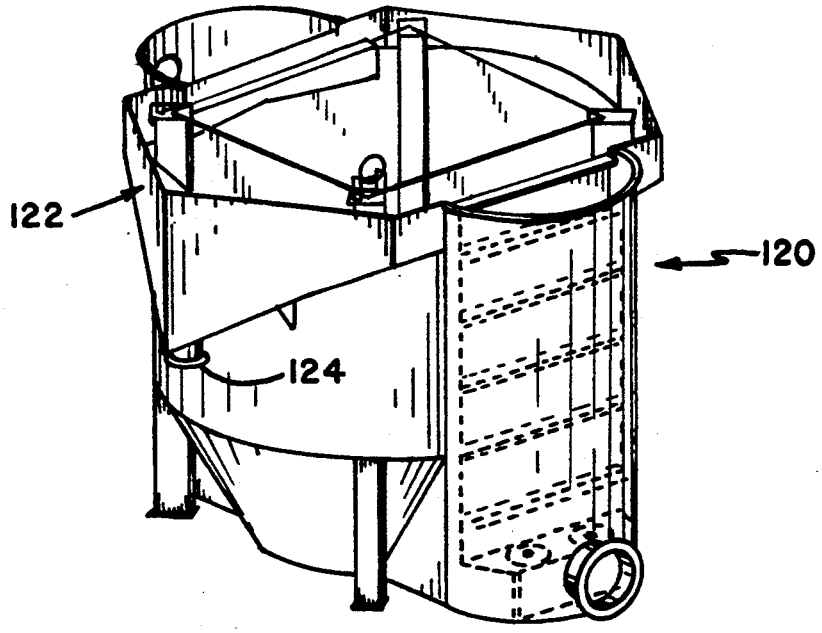
FIG. 4 is a perspective view of a single cylindrical cell and hexagonal overflow froth launder in accordance with the invention.

FIG. 4 is a perspective view of a flotation cell embodying the invention. Cylindrical cell 120 contains a hexagonal overflow froth launder 122. Launder discharge outlet 124 can be attached to an outlet pipe for collection of mineral rich froth.

The present invention provides an advantageous structure and operation. Cylindrical cell construction eliminates heavy reinforcement requirements as well as undesirable turbulent corner effects which harm desired efficient froth removal of minerals. Further, hexagonally shaped overflow froth launders optimize froth collection and allow for a unique beehive nesting arrangement.

The foregoing advantages are particularly advantageous with large flotation projects thereby minimizing costs and enhancing mineral collection.

While there has been described a particular embodiment of the invention, it will be apparent to those skilled in the art that variations may be made thereto without departure from the spirit and scope of the appended claims.

What is claimed is:

1. A froth flotation machine comprising:

(a) at least one upright cylindrical flotation cell having an upper end;

(b) an inlet box attached to said cell, (c) a discharge box attached to said cell;

(d) a rotation mechanism means contained in said cell for producing a mineral rich froth; and (e) an hexagonally shaped overflow froth launder mounted to and circumferentially extending about the entire periphery of said upper end of said flotation cell for collection of said mineral rich froth.

2. A flotation machine comprising a plurality of flotation cells and hexagonal overflow froth launders as claimed in claim 1 arranged in honeycomb configuration.

3. A flotation machine in accordance with claim 2 wherein a junction box is provided to separate cells.

4. An improved flotation machine including an array of at least two rows of cylindrical flotation cells, an inlet port in the cell at one end of each row of cells for feeding into said end cell finely divided mineral ore and a fluid, a discharge port in the cell at the opposite end of the row of cells for removal of unseparated fluid and ore from said cell an aeration means located in each cell for creating a mineral-rich froth therein, a hexagonal shaped overflow froth launder provided on each of aid cells for collection of said mineral-rich froth, said hexagonal shaped overflow launders of a first row of cells contacting the hexagonal overflow launders of an adjacent row of cells in a honeycomb configuration.

5. A flotation machine in accordance with claim 4 wherein a junction box is provided in each of said rows to separate cells.

6. A flotation machine comprising an array of at least two rows of cylindrical flotation cells, each of said cells provided with a hexagonal overflow froth launder, the hexagonal launders in one of said rows contacting the hexagonal launders of an adjacent row in a honeycomb configuration, each of said cells having an inlet means, an outlet means, and aeration means located in each of said cylindrical cells.

7. A flotation machine according to claim 6 wherein the aeration means comprises a rotation mechanism.

8. A flotation machine according to claim 6 wherein a junction box is provided to separate at least two cells.

* * * * *